United States Patent [19]

Epperson

[11] B 3,995,989

[45] Dec. 7, 1976

[54] SPLIT RING BURNER FOR WELD PREHEAT

[75] Inventor: Robert Allen Epperson, Chattanooga, Tenn.

[73] Assignee: Combustion Engineering, Inc., Windsor, Conn.

[22] Filed: Dec. 26, 1974

[21] Appl. No.: 536,511

[44] Published under the second Trial Voluntary Protest Program on March 9, 1976 as document No. B 536,511.

[52] U.S. Cl. ..... 432/49; 266/87; 266/252

[51] Int. Cl.[2] ..... F23D 19/00

[58] Field of Search ..... 432/49; 236/1 A; 266/5 F, 5 T

[56] References Cited

UNITED STATES PATENTS

| | | | |
|---|---|---|---|
| 2,296,387 | 9/1942 | Inskeep et al. | 266/5 F |
| 3,107,904 | 10/1963 | Dailey | 432/49 |

*Primary Examiner*—Carroll B. Dority, Jr.
*Attorney, Agent, or Firm*—Robert L. Olson

[57] ABSTRACT

Burner means for maintaining a weld in a large metal member at a predetermined temperature for extended periods of time regardless of the position of the weld, including two independent burners, and two independent control arrangements for the two burners, such that they maintain the entire weld at substantially the same predetermined temperature, in spite of the unbalancing effect of heat from the other burner.

2 Claims, 2 Drawing Figures

SPLIT RING BURNER FOR WELD PREHEAT

BACKGROUND OF THE INVENTION

Large nuclear reactor vessels generally have a number of large nozzles attached to them, through which the fluid can enter and leave. These nozzles are welded into the reactor vessel. A typical 10 to 20 foot diameter vessel may have four equally spaced, 3 foot diameter nozzles welded therein. The welding of these nozzles into the vessel is a time consuming process, generally taking from four to 6 weeks. In order to prevent undue thermal stresses in the weld metal which could cause later cracks or failure of the welds, it is essential that all of the welds be maintained at a predetermined temperature during the 4 to 6 week period until all of the welding has been completed, and the finished vessel can be properly heat treated in a large heat treating furnace. During this 4 to 6 week welding period it is desirable to maintain the nozzle welds within the range of 350° – 500°F with a 50° maximum differential between hottest and coldest point. This has presented problems in the past because of the largeness of the welds, and because the vessel is rotated to different positions during the welding of the nozzles.

SUMMARY OF THE INVENTION

The burner means of the invention maintains a vertically positioned weld in a large metal member at a predetermined temperature for extended periods of time, and includes first and second burners, the first being positioned below the second, first temperature sensing means positioned adjacent a lower portion of the weld, second temperature sensing means positioned adjacent an upper portion of the weld, first control means for controlling the flow of fuel and air to the first burner, second control means for controlling the flow of fuel and air to the second burner, the first temperature sensing means being connected to the first control means and the second temperature sensing means being connected to the second control means such that the temperature of the entire weld remains substantially equal, at the predetermined temperature, in spite of the unbalancing effect of rising heat from the lower burner.

DESCRIPTION OF THE PREFERRED EMBODIMENT

Figure 1:
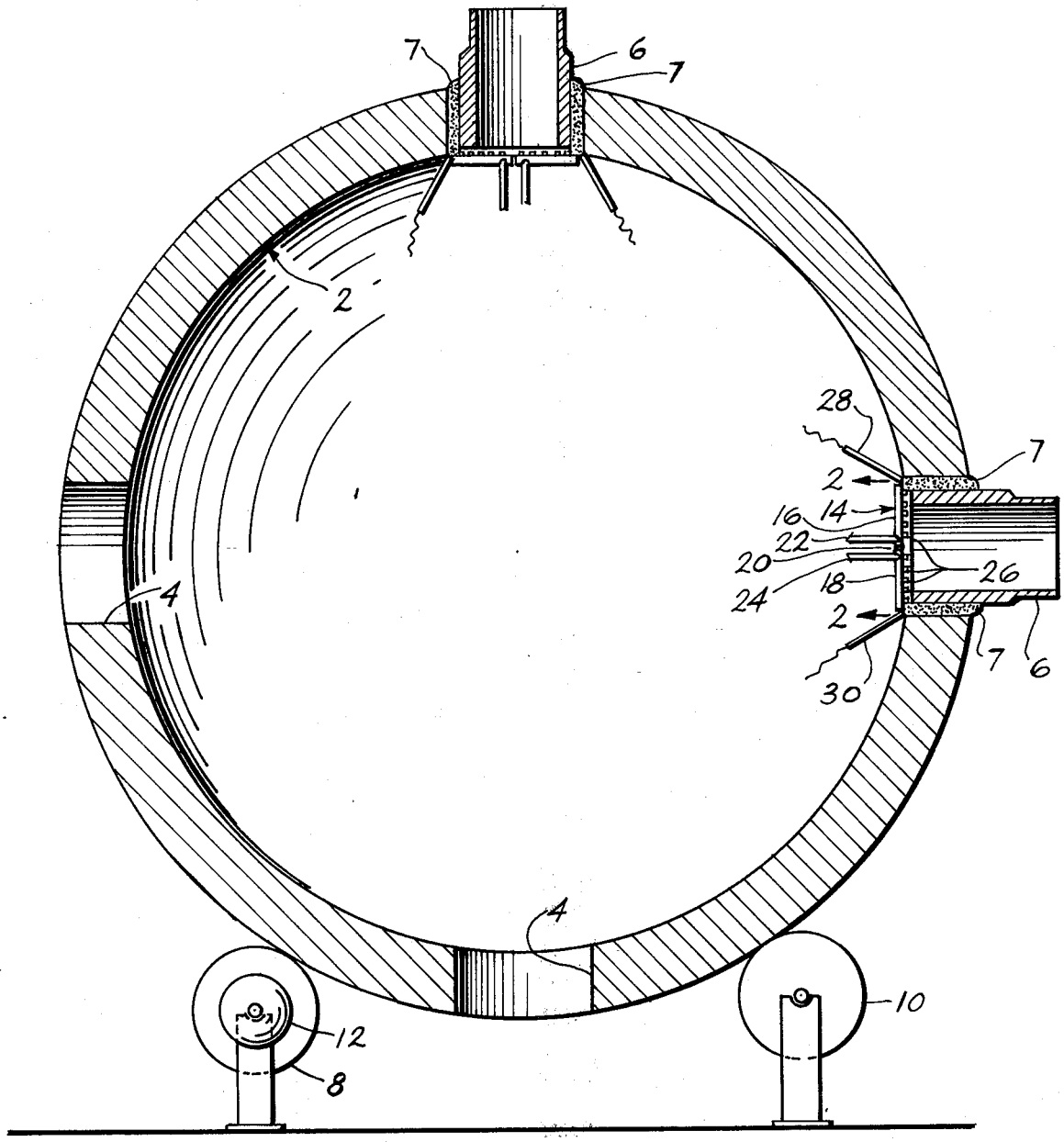
FIG. 1 is a sectional view of a large vessel to which nozzles are to be welded, which utilizes the split ring preheat burner of the invention.

Looking now to FIG. 1, numeral 2 denotes a large cylindrical nuclear reactor vessel, having circular openings 4 in the side walls thereof, into which nozzles 6 are secured by weld metal 7. The vessel 2 is supported on pairs of rollers 8 and 10, one pair each at opposite ends of the cylindrical vessel. The rollers 8 are driven by a pair of motors 12, so that the vessel 2 can be rotated 90° when one nozzle has been welded in place, and another is to be started on. As seen in FIG. 1, two nozzles 6 are shown welded in place, and it is necessary to keep the weld metal 7 of these nozzles at a predetermined temperature, for example 350° – 500°F, until all of the welding is completed and the entire vessel can be heat treated.

Split ring burners 14 are used to maintain the finished welds 7 at a predetermined temperature during the weeks that welding of the remaining nozzles is taking place. Each nozzle 6 is 2 to 3 feet in diameter, and thus because of the large size, presents problems in temperature equalization when the vessel is in certain positions. When the nozzle is at the top or bottom vessel position, temperature differentials are not a significant problem. However, when the nozzle is positioned as shown on the right hand side in FIG. 1, temperature differentials become a problem. In this position, the weld metal at the top of the nozzle, by means of natural convection, gets hotter than the weld metal at the nozzle bottom. This temperature differential is undesirable because it introduces unwanted gradients in the weld and may contribute to weld cracking.

To prevent this problem from arising, each burner ring 14 is made up of two independent semi-circular burners 16 and 18. The lower portion 18 is supplied with a gaseous fuel and air mixture through pipe 24, and the upper portion 16 is supplied with fuel and air through pipe 22. A pair of divider plates 20 separates the passage in the upper burner from the passage in the lower burner. The fuel-air mixture in each burner is discharged through the burner discharge ports 26, to direct a circular flame against the weld metal 7. Each burner 16 and 18 has its own independent control, described in more detail below, and is responsive to its own temperature sensing means 28 or 30.

Figure 2:
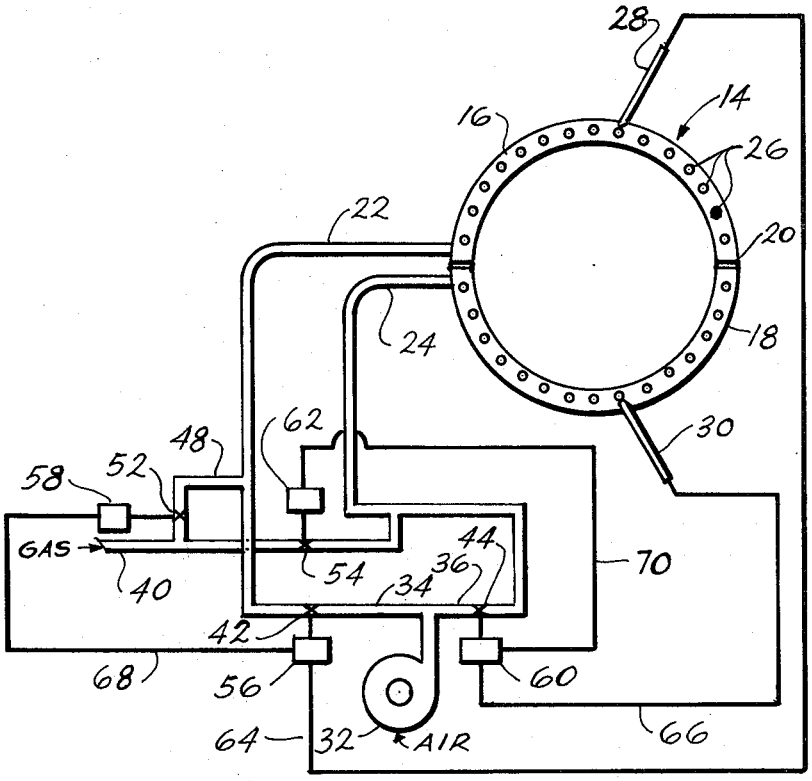
FIG. 2 is a schematic of the split ring preheat burner and its associated controls.

Looking now to FIG. 2, a schematic arrangement of the burner means 14, and the controls therefore, is shown. Air is supplied to the pipes 22 and 24 by means of fan 32 and branch air ducts 34 and 36. Dampers 42 and 44 control the amount of air ultimately supplied to each respective burner, 16 or 18. Fuel supply line 46 supplies a gaseous fuel to branch pipes 48 and 50, which pipes contain throttle valves 52 and 54, respectively for controlling the amount of fuel flowing to its respective burner. Controllers 56 and 58 determine the opening and closing of damper 42 and valve 52 for the upper burner 16. These controllers respond to a signal sent through circuitry 64 and 68 from temperature sensing device 28. In like manner, controllers 60 and 62 determine the opening and closing of damper 44 and valve 54 for the lower burner 18. These controllers respond to a signal from temperature sensing device 30 through circuits 66 and 70. The valves and dampers can be of the on-off type. More desirably, however, they modulate; i.e. they always supply a small amount of fuel and air to their respective burner, so that a low flame always exists, and when their respective temperature sensing device calls for more heat, the damper and valve are opened more.

The controllers can be set to maintain the weld metal within a narrow temperature range. Thus, if it is desired to maintain the weld at 350°±25°, the controllers would be set at 350°F. The controllers then operate to open and close the respective damper and valve to hold the weldment at that preset temperature. Modulating controllers will maintain a weldment to ± 20°F of set point temperature. As can be seen, each burner 16 and 18 is controlled entirely independent of the other. Because of heat rising from the lower burner 18, the upper burner 16 will be supplied with much less fuel and air over a given period of time.

It should be understood that the control arrangement shown in FIG. 2 is only schematic, and that for the sake of simplicity much has been omitted which does not form a necessary part of the invention. For example, a spark ignitor would be necessary for each burner 16 and 18. Also, flame detecting means and shut-off vlaves responsive thereto would be provided for each burner.

What is claimed is:

1. In combination, burner means for maintaining a large, vertically positioned weld in a large metal member at a predetermined temperature for extended periods of time, including first and second burners, the first being positioned below the second, first temperature sensing means positioned adjacent a lower portion of the weld, second temperature sensing means positioned adjacent an upper portion of the weld, first control means for controlling the flow of fuel and air to the first burner, second control means for controlling the flow of fuel and air to the second burner, the first temperature sensing means being connected to the first control means and the second temperature sensing means being connected to the second control means, such that the temperature of the entire weld remains substantially equal, at the predetermined temperature, in spite of the unbalancing effect of rising heat from the lower burner.

2. The combination set forth in claim 1, wherein the weld is a circular weld and the two burners are each semi-circular, and are positioned so that together they form a complete circular burner arrangement.

* * * * *